United States Patent [19]

Raso et al.

[11] Patent Number: 4,939,492

[45] Date of Patent: Jul. 3, 1990

[54] ELECTROMAGNETIC TRIP DEVICE WITH TRIPPING THRESHOLD ADJUSTMENT

[75] Inventors: André Raso, Claix; Pierre Laffont, Sassenage; Denis Vial, Fontaine, all of France

[73] Assignee: Merlin Gerin, France

[21] Appl. No.: 298,365

[22] Filed: Jan. 18, 1989

[30] Foreign Application Priority Data

Jan. 28, 1988 [FR] France ..... 88 01100

[51] Int. Cl.[5] ..... H01H 75/10

[52] U.S. Cl. ..... 335/42; 335/174

[58] Field of Search ..... 335/42, 63, 67, 105, 335/194, 250, 251, 274, 172–176

[56] References Cited

U.S. PATENT DOCUMENTS

| | | | |
|---|---|---|---|
| 905,136 | 12/1908 | Barnum | 335/251 |
| 1,354,810 | 10/1920 | Canfield . | |
| 3,505,623 | 4/1970 | Gryctko . | |
| 4,278,959 | 7/1987 | Nishimiya et al. | 335/251 |
| 4,603,312 | 7/1986 | Conner . | |

FOREIGN PATENT DOCUMENTS

| | | | |
|---|---|---|---|
| 1107797 | 5/1961 | Fed. Rep. of Germany . | |
| 57-43509 | 9/1983 | Japan | 335/251 |
| 415387 | 8/1934 | United Kingdom . | |

*Primary Examiner*—Leo P. Picard
*Assistant Examiner*—Lincoln Donovan
*Attorney, Agent, or Firm*—Arnold, White & Durkee

[57] ABSTRACT

The tripping adjustment range of a magnetic trip device with a plunger core is increased by providing, in the movable plunger core, a groove whose edges define polar surfaces bounding air-gaps with the edges of the yoke in such a way as to generate in the minimum adjustment position a force which is added to the attractive force of the movable core by the stationary core, and inversely a force in the maximum adjustment position which is subtracted from the attractive force of movable plunger core. The trip device excitation coil is offset with respect to the yoke to increase the adjustment range, and a return device with adjustable stop and decreasing return force as the movable core approaches the stationary core, contributes to increasing this tripping threshold adjustment range.

10 Claims, 4 Drawing Sheets

ELECTROMAGNETIC TRIP DEVICE WITH TRIPPING THRESHOLD ADJUSTMENT

BACKGROUND OF THE INVENTION

The invention relates to an electromagnetic trip device for an electrical protective device, with instantaneous tripping threshold adjustment, comprising a casing or yoke presenting a lower face and an upper face, a movable plunger core axially across an orifice arranged in the upper face, a coil fitted between said faces and arranged around the movable core, a stationary core securedly fixed to the lower face of the casing, and a return spring urging the movable core in the opposite direction from the stationary core.

A trip device of this kind is, for example, used to bring about instantaneous tripping of a short-circuit current protective device, notably a circuit breaker or contactor, when the current intensity flowing in the coil is sufficiently great to cause the plunger core to be attracted. The tripping threshold must be perfectly defined and adjustable, and it has already been proposed to modify the initial position of the movable core, in order to reduce or increase the air-gap separating it from the stationary core or to modify the return force of the moving core, to adjust this tripping threshold. The adjustment ranges obtained by these means are limited and the need arises for additional adjustment means without any notable complications being made to the trip device.

The object of the present invention is to achieve an electromagnetic trip device with a tripping threshold that can be adjusted accurately over a wide range.

SUMMARY OF THE INVENTION

The elctromagnetic trip device according to the invention is characterized by an adjustment device of the initial position of the movable core between a maximum separation position from the stationary core and a minimum position and by an annular groove arranged in said movable core over a slightly greater axial distance than the axial distance between said maximum and minimum positions, in the zone of said upper face, in such a way that the latter is in proximity to one of the edges of the groove in one of said positions and in proximity to the other of the edges of the groove in the other of said positions.

The groove arranged in the movable core defines a second air-gap in the magnetic circuit energized by the coil, and this second air-gap generates an attractive force of the movable core which is added to that of the stationary core when the movable core is in the minimum separation position from the stationary core and inversely, a retaining force of the movable core which is subtracted from the attractive force of the stationary core when the movable core is in the maximum separation position from the stationary core. The special shape of the core enables the adjustment range to be increased while keeping the same movable core travel, the adjustment precision of the tripping values being increased.

The trip device according to the invention advantageously presents a longitudinal symmetry axis on which the cylindrical-shaped movable core is slidingly mounted. The groove arranged in the movable core defines a section or portion of reduced cross-section, which is connected to the two portions which surround it, by inclined edges shaped as cone frustums. The bistable equilibrium of the plunger core, indispensable to obtain a clean tripping threshold, is improved by the presence of the groove and by the use of a return device with decreasing force in the course of the movement of the movable core in the direction of the stationary core. This decreasing force exerted on the movable core is obtained by a modification of the line of action of the return spring which acts on a pivoting lever with modification of the lever arm. This variation of the return force exerted on the moving core in terms of its position also extends the tripping threshold adjustment range.

According to a development of the invention, the coil is offset in such a way as, in the minimum adjustment position of the moving core, to locate the air-gap separating the moving core from the stationary core in the center of the coil where the intensity of the magnetic field is highest. In the maximum position, the movable core is almost outside the coil in a reduced field area which results in a higher tripping threshold.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
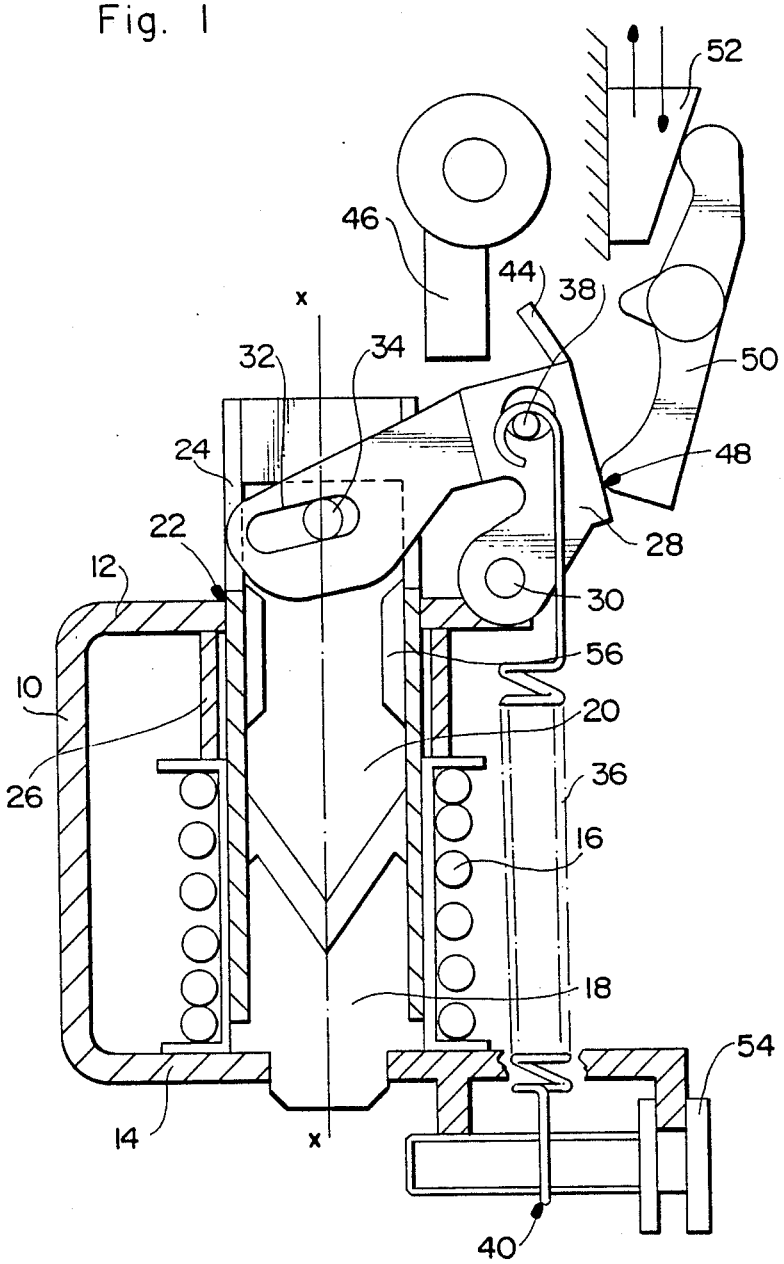
FIG. 1 is a schematic axial sectional view of an electromagnetic trip device according to the invention, represented in the initial minimum adjustment position.
Figure 2:
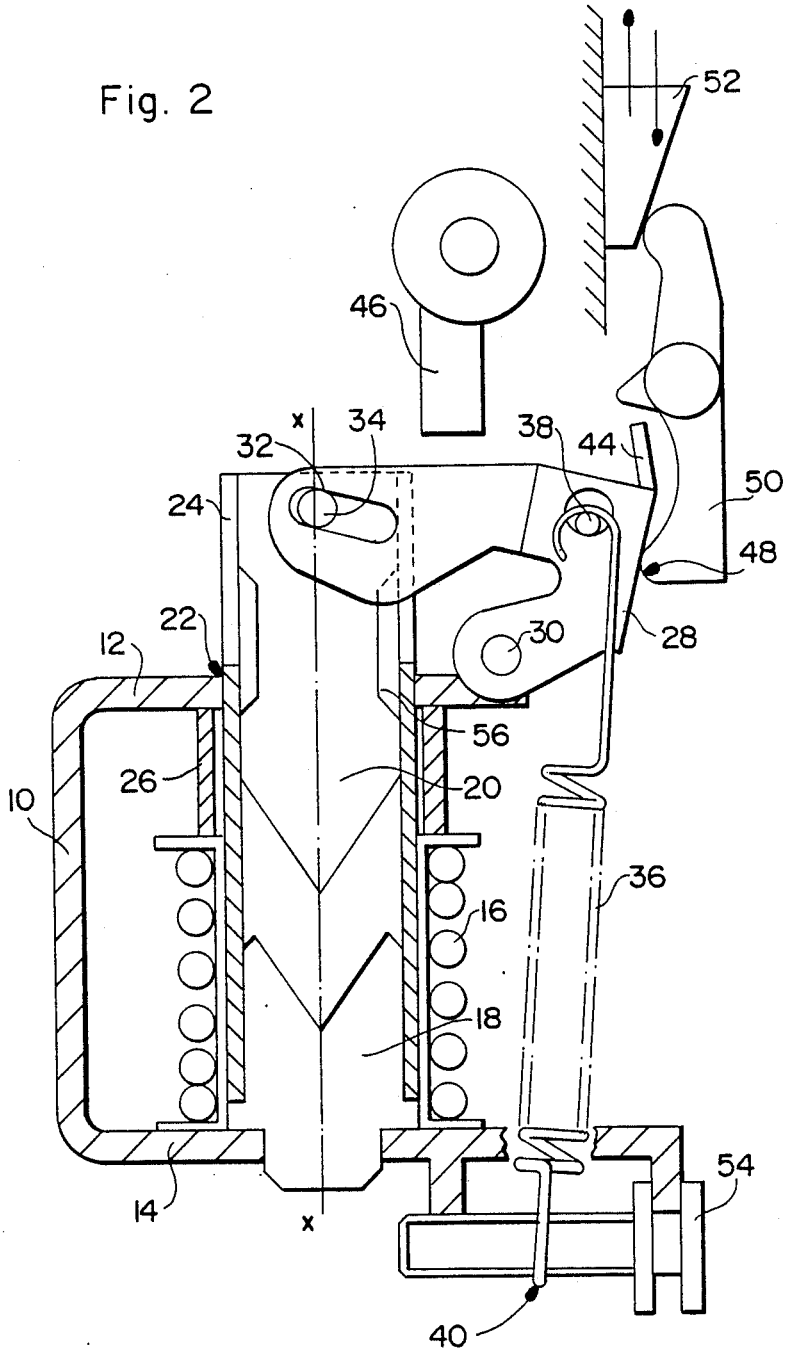
FIGS. 2 and 3 are similar views to that of FIG. 1 representing the trip device respectively in the maximum adjustment position and the tripping position.
Figure 3:
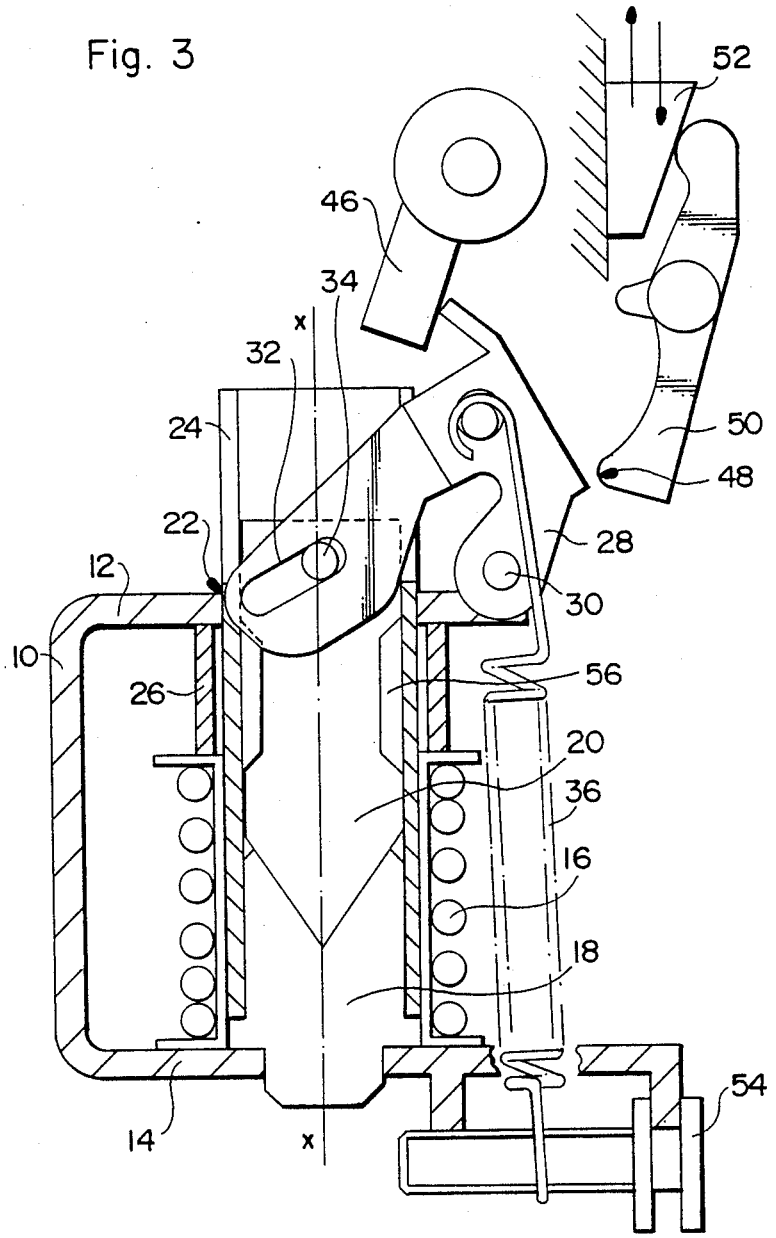

In the figures, a U-shaped yoke 10 which can also be a partly or completely closed case, has an upper face 12 and a lower face 14, surrounding a coil 16 connected to an electrical circuit which is not represented. The lower face 14 supports a stationary core 18 penetrating axially into the coil 16 and operating in conjunction with a movable core 20 slidingly mounted according to a symmetry axis XX of the trip device. The yoke 10, the stationary core 18 and the movable core 20 are made of a suitable magnetizable material well-known to those specialized in the art. The upper face 12 has an orifice 22 for the movable core 20 to pass through with a cylindrical sheath 24 interposed made of non-magnetic insulating material and sheathing the stationary core 18 and movable core 20 assembly. The coil 16 is axially offset in the direction of the lower face 14 being mechanically held by a spacer 26 fitted between the upper face 12 of the yoke 10 and the top of the coil 16. Any other means of fixing the coil can naturally be used. A pivoting lever 28 is mounted on a stationary pivoting spindle 30, for example supported by the yoke 10 and is mechanically connected to the movable core 20 via an aperture 32, in which a pin 34 supported by the movable core 20 is engaged. A return spring 36 is secured on the one hand to a point 38 of the pivoting lever 28, and on the other hand to a point 40. The fixing points 38, 40 are arranged with respect to the pivoting spindle 30 of the pivoting lever 28, in such a way as to exert on the latter a moment urging the pivoting lever clockwise, corresponding to an upward movement of the moving core 20 in FIG. 1. The link via the aperture 32 and pin 34 transforms the pivoting movement of the pivoting lever 28 into a sliding movement of the movable core 20. The pivoting lever 28 supports a tongue 44 actuating a trip bar 46, for example of an electrical protection circuit breaker. The pivoting lever 28 operates in conjunction with a stop 48 arranged on one of the arms of a rocker 50, the other arm of which operates in conjunction with an adjusting wedge 52, slidingly controlled by any suitable means, notably by an adjustment screw which is not represented. The return spring 36 urges the pivoting lever 28 against the stop 48, the position of which defines the initial position of the plunger core 20. It can easily be seen that insertion of the adjusting wedge 52 causes a downward movement of the movable core 20 in the direction of the stationary core 18, and inversely that withdrawal of the wedge 52 allows the moveable core 20 to move away from the stationary core 18, the two extreme adjustment positions, i.e. the minimum position and the maximum position, being represented in FIGS. 1 and 2. When the coil 16 is not energized, the movable core 20 is held in the position separated from the stationary core 18, this initial position being, depending on the position of the adjusting wedge 52, either the minimum adjustment position represented in FIG. 1, or the maximum adjustment position represented in FIG. 2, or any intermediate position between these two extreme positions. Energization of the coil 16 causes attraction of the movable core 20, which moves when the current flowing in the coil 16 exceeds a preset threshold sufficient to overcome the return forces notably exerted by the spring 36 on the movable core 20. FIG. 3 illustrates the attracted position of the movable core 20 which causes the trip bar 46 to be actuated by the tongue 44 of the pivoting lever 28. When the coil 16 is de-energized, the return spring 36 returns the assembly to the initial position in readiness for another operation. The fixing point 40 of the spring 36 can be moved by an adjusting screw 54 to adjust the line of action of the return spring 36, and thus modify the return force exerted on the movable core 20.

Figure 4:
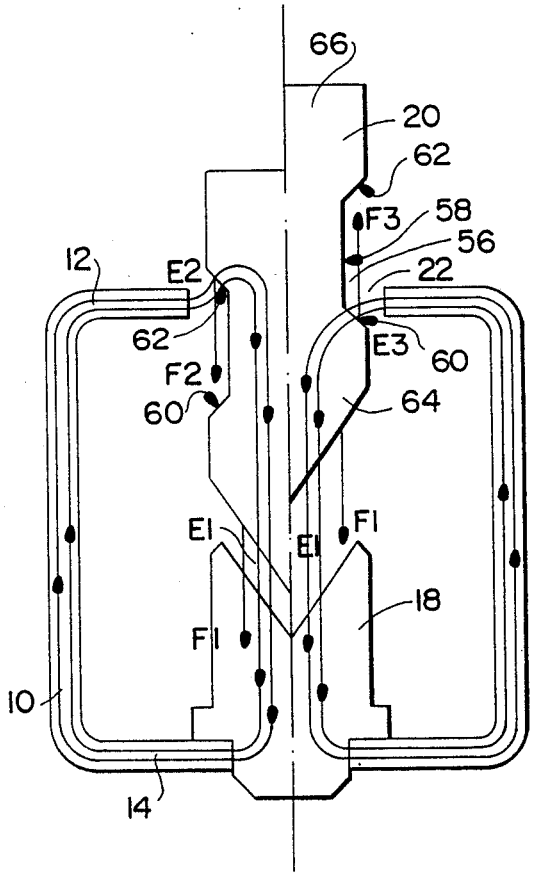
FIG. 4 shows the field lines of the magnetic circuit, represented in the left-hand half-view in the minimum adjustment position and in the right-hand half-view in the maximum adjustment position.

Referring more particularly to FIG. 4, it can be seen that the movable core 20 presents according to the invention a groove 56 with a cylindrical-shaped bottom 58 and inclined lower 60 and upper 62 edges. The edges 60, 62, shaped as cone frustums, provide connection of the groove 56 to the lower 64 and upper 66 portions of the movable core 20 of widened cross-section. In the minimum adjustment position represented on the left-hand part of FIG. 4, the magnetic flux flows through a first air-gap E1 between the movable core 20 and the stationary core 18, then the lower face 14, the yoke 10, the upper face 12 and a second air-gap E2 between the edge of the orifice 22 and the edge 62 of the groove 56. An attractive force F1 tends to attract the movable core 20 towards the stationary core 18 to reduce the first air-gap E1 and a second force F2 is added to this force F1 at the level of the second air-gap E2. The groove 56 is arranged in such a way that in the minimum adjustment position, the edge 62 is slightly above the orifice 22 to generate a force having a component F2 oriented in the direction of the stationary core 18. In the maximum adjustment position represented in the right-hand part of FIG. 4, the air-gap E1 is notably increased and the edge 60 comes to face the orifice 22, remaining however below the upper face 12. The air-gap E3 between the polar surface constituted by the edge 60 and the polar surface constituted by the edge of the orifice 22, generates a force F3 oriented in the opposite direction from the attractive force F1 of the movable plunger core 20 in the direction of the stationary core 18. It can be easily be seen that the forces F2 and F3, due to the groove 56, respectively enable the minimum tripping threshold to be lowered and the maximum tripping threshold to be increased, which corresponds to an extended tripping threshold range, the force F1 becoming preponderant at a certain moment.

An additional effect results from the offset of the coil 16 in the direction of the lower face 14 so as to dispose the air-gap E1, in the minimum position, in the proximity of the center of the coil 16 in a high field area and to offset this air-gap E1 in the maximum position towards a reduced field area at the edge of the coil 16. It is clear that the current intensity, flowing through the coil 16, required to attract the movable core 20 and bring about tripping will be lower in the minimum adjustment position and greater, due to the reduction of the field at the edge of the coil, in the maximum position of the movable plunger core 20. Changing the line of action of the return spring 36, when pivoting of the pivoting lever 28 occurs so as to reduce the return force exerted on the movable plunger core 20 when the latter moves towards the stationary core 18, acts in the same way to extend the tripping threshold range. In the example described in the figures, the polar surfaces of the air-gap E1 are conical but they can naturally be flat and the height of the stationary core 18 can be reduced. The return device can be arranged differently and the guiding sheath 24 can be replaced by any other means, notably by a guiding rod passing through the movable plunger core 20. The polar surface of the yoke 10 defining the air-gap E2 and E3 can be shaped differently, and in particular be increased to modify the distribution of the field lines, without departing from the spirit of the present invention.

We claim:

1. An electromagnetic trip device for an electrical protective device, with adjustment of the instantaneous tripping threshold, comprising a yoke presenting a lower face and an upper face, a movable plunger core movable axially across an orifice arranged in the upper face, a coil fitted between said faces and arranged around the movable core, a stationary core securedly fixed to the lower face of the yoke, a return spring urging the movable core in the opposite direction from the stationary core, a magnetic circuit comprising said yoke, the movable core and the stationary core and having a first air-gap defined between the movable core and the stationary core, an adjustment device of the position of the movable core between a maximum separation position from the stationary core and a minimum position and an annular groove provided in said movable core over a greater axial distance than the axial distance between said maximum and minimum positions, in the zone of said upper face, in such a way that the latter is in proximity to a first edge of the groove in one of said positions and in proximity to the a second edge of the groove in the other of said positions, a second air-gap defined between said upper face and said first edge and a third air gap defined between said upper face and said second edge.

2. The electromagnetic trip device with a cylindrical movable core according to claim 1, wherein said groove defines an intermediate cylindrical portion of the movable core of a reduced cross-section.

3. The electromagnetic trip device according to claim 2, wherein the first and second edges of said groove are shaped as two cone frustums connecting the intermediate portion to the two cylindrical portions of the movable core to define with said upper face of the yoke an inclined air-gap, capable of generating a force having an axial component.

4. The electromagnetic trip device according to claim 1, wherein said orifice in the upper face surrounds the movable core.

5. The electromagnetic trip device according to claim 1, wherein a pivoting lever is connected to the movable core and controls tripping in the attracted position of the movable core, and an adjustable stop operates in conjunction with said pivoting lever to define the initial position of the movable core.

6. The electromagnetic trip device according to claim 1, wherein said return spring is arranged to exert on the movable core a return force which is variable with the position of the movable core and which decreases from the maximum position to the minimum position of the movable core.

7. The elctromagnetic trip device according to claim 6, wherein said return spring exerts a moment on said pivoting lever whose arm decreases between the maximum position and the minimum position of the movable core.

8. The electromagnetic trip device according to claim 7, wherein the fixing point of the return spring is adjustable to adjust the return force exerted on the movable core.

9. The electromagnetic trip device according to claim 1, wherein said coil is axially offset in the direction of said lower face and surrounds the stationary core supported by said lower face which penetrates into the coil.

10. The electromagnetic trip device according to claim 9, wherein the movable coil is is substantially outside said coil when it is in said maximum position.

* * * * *